US005389944A

United States Patent [19]

Collinge et al.

[11] Patent Number: 5,389,944

[45] Date of Patent: Feb. 14, 1995

[54] PHASE CORRECTING REFLECTION ZONE PLATE FOR FOCUSING MICROWAVE

[75] Inventors: Gary Collinge, Suffolk; Thomas M. B. Wright, Herts, both of United Kingdom

[73] Assignee: Mawzones Developments Limited, United Kingdom

[21] Appl. No.: 969,283

[22] PCT Filed: Jul. 10, 1991

[86] PCT No.: PCT/GB91/01136

§ 371 Date: Aug. 9, 1993

§ 102(e) Date: Aug. 9, 1993

[87] PCT Pub. No.: WO92/01319

PCT Pub. Date: Jan. 23, 1992

[30] Foreign Application Priority Data

Jul. 10, 1990 [GB] United Kingdom ..... 9015159

[51] Int. Cl.[6] ..... H01Q 15/02

[52] U.S. Cl. ..... 343/910; 343/914

[58] Field of Search ..... 343/910, 753, 914, 911 R; 29/600; H01Q 15/23, 15/02

[56] References Cited

U.S. PATENT DOCUMENTS

| | | | |
|---|---|---|---|
| 1,906,546 | 5/1933 | Darbord | 343/840 |
| 2,856,602 | 10/1958 | Carlin | 343/753 |
| 2,921,312 | 1/1960 | Wickersham, Jr. | 343/911 R |
| 3,189,907 | 6/1965 | Buskirk | 343/753 |
| 3,530,475 | 9/1970 | Danielson | 343/910 |
| 4,905,014 | 2/1990 | Gonzalez et al. | 343/909 |

FOREIGN PATENT DOCUMENTS

| | | | |
|---|---|---|---|
| 0181617 | 5/1986 | European Pat. Off. | 19/19 |
| 3536348A1 | 4/1987 | Germany | 15/14 |
| 3801301 | 7/1989 | Germany | H01Q 15/23 |
| 2236019 | 3/1991 | United Kingdom | H01Q 15/23 |

OTHER PUBLICATIONS

"International Journal of Infrared and Millimeter Waves", vol. 2, No. 3, Mar. 1991, New York, US, pp. 195–219; J. E. Garrett et al., Fresnel Zone Plate Antennas At Millimeter Wavelengths, see pp. 209–210.

*Primary Examiner*—Donald Hajec
*Assistant Examiner*—Tan Ho
*Attorney, Agent, or Firm*—Westman, Champlin & Kelly

[57] ABSTRACT

A zone plate for focusing microwave energy is provided comprising a plurality of reflective portions corresponding to zones of the zone plate, each reflective portion reflecting energy λ/P out of phase with respect to adjacent reflective portions, where λ is the wavelength of the energy. The reflective portions are positioned in P parallel planes mounted on low dielectric loss sheets and separated by a distance of λ/2P such that energy reflected from the reflective portions constructively interfere at a focus of the zone plate.

18 Claims, 11 Drawing Sheets

PHASE CORRECTING REFLECTION ZONE PLATE FOR FOCUSING MICROWAVE

BACKGROUND OF THE INVENTION

This invention relates to a zone plate for focusing microwave energy and in particular to a phase correcting reflection zone plate for focusing microwaves. This invention also relates to apparatus and a method for manufacturing such a zone plate.

The use of zone plates for focusing microwaves is well known. One particular type of zone plate disclosed in "Millimeter-Wave Characteristics of Phase-Correcting Fresnal Zone Plates" by D. N. Black and J. Wiltse, IEEE Transactions on Microwave Theory and Technique Volume 35 No. 12 (1987) Page 1122–1128, is the phase-correcting Fresnel zone plate. Such a zone plate is shown schematically in FIG. 1 for quarter wave correction, although a phase correcting zone plate can be made for any wavelength fraction. The radius of each zone $r_n$ can be given by $$r_n = \left( \frac{2nf\pi}{P} - \left( \frac{n\lambda}{P} \right)^2 \right)^{\frac{1}{2}}$$

where n is the zone number, f is the focal length of the zone plate, λ is the wavelength of the radiation and P is an integer greater than 2. For quarter wave correction P=4. For such a zone plate both in and out of phase zones contribute to the energy at the focus thus increasing the efficiency compared to a conventional zone plate. The correction of the phase of the zones is achieved by changing the path length of the energy reflected from that zone. Thus the energy reflected from the zone 2*a* of the quarter wave zone plate of FIG. 1 would be out of phase with respect to the energy from the zone 3 by λ/4 at the focus, unless the pathlength was decreased or increased by λ/4. An increase in pathlength of λ/4 is achieved by providing steps λ/8 in depth. Thus zone 2*a* is λ/8 higher than zone 3 and zone 2*b* and 2*c* are λ/4 and 3λ/8 higher than zone 3 respectively. More generally, the different phases of the zones of the zone plate are stepped by d where $$d = \lambda o / 2P$$

where λo is the free space wavelength of the radiation.

The construction of such a zone plate may be achieved by a number of manufacturing processes such as machining out of solid metal, stamping out of a thin metal sheet, moulding and subsequently metallising a plastic material or by vacuum forming plastics.

SUMMARY OF THE INVENTION

According to the present invention a reflection zone plate for focusing microwave energy comprises a plurality of reflective portions corresponding to zones of said zone plate; said reflective portions being positioned in P parallel planes, so that each said reflective portion reflects energy λ/P out of phase with respect to adjacent reflective portions, where λ is the wavelength of the energy, such that energy reflected from said reflective portions constructively interfere at a focus of said zone plate; wherein the reflective portions in each said plane are formed on respective low dielectric loss sheets.

In a preferred embodiment each reflective portions reflects energy λ/4 out of phase with respect to adjacent reflective portions and said reflective portions are positioned in 4 parallel planes and separated by an electrical thickness of λ/8. In such an arrangement the sheets may be constructed from a plastics material.

The present invention also provides apparatus for the manufacture of such a zone plate, comprising means to apply reflective portions corresponding to zones of said zone plate to the surface of a plurality of sheets of low dielectric loss material; and means to stack said sheets of low dielectic loss material to form said reflection zone plate.

The present invention further provides a method of manufacture of such a zone plate comprising the steps of applying reflective portions corresponding to zones of said zone plate to the surface of a plurality P of sheets of low dielectric loss material, and stacking said plurality of sheets of low dielectric loss material to form said reflective zone plate.

BRIEF DESCRIPTION OF THE DRAWINGS

Examples of the invention will now be described with reference to the drawings, in which.

DESCRIPTION OF THE PREFERRED EMBODIMENTS

Figure 1:
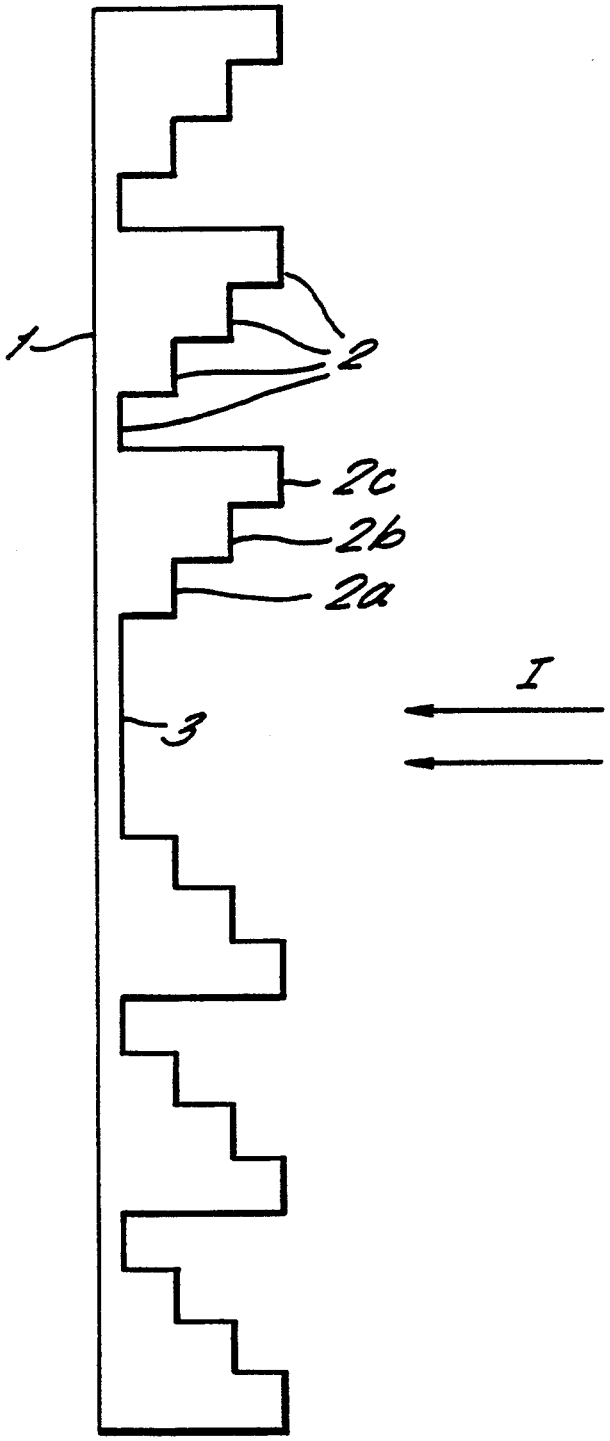
FIG. 1. PRIOR ART
FIG. 1 illustrates a cross-section of a prior art quarter wave zone plate.
Figure 2:
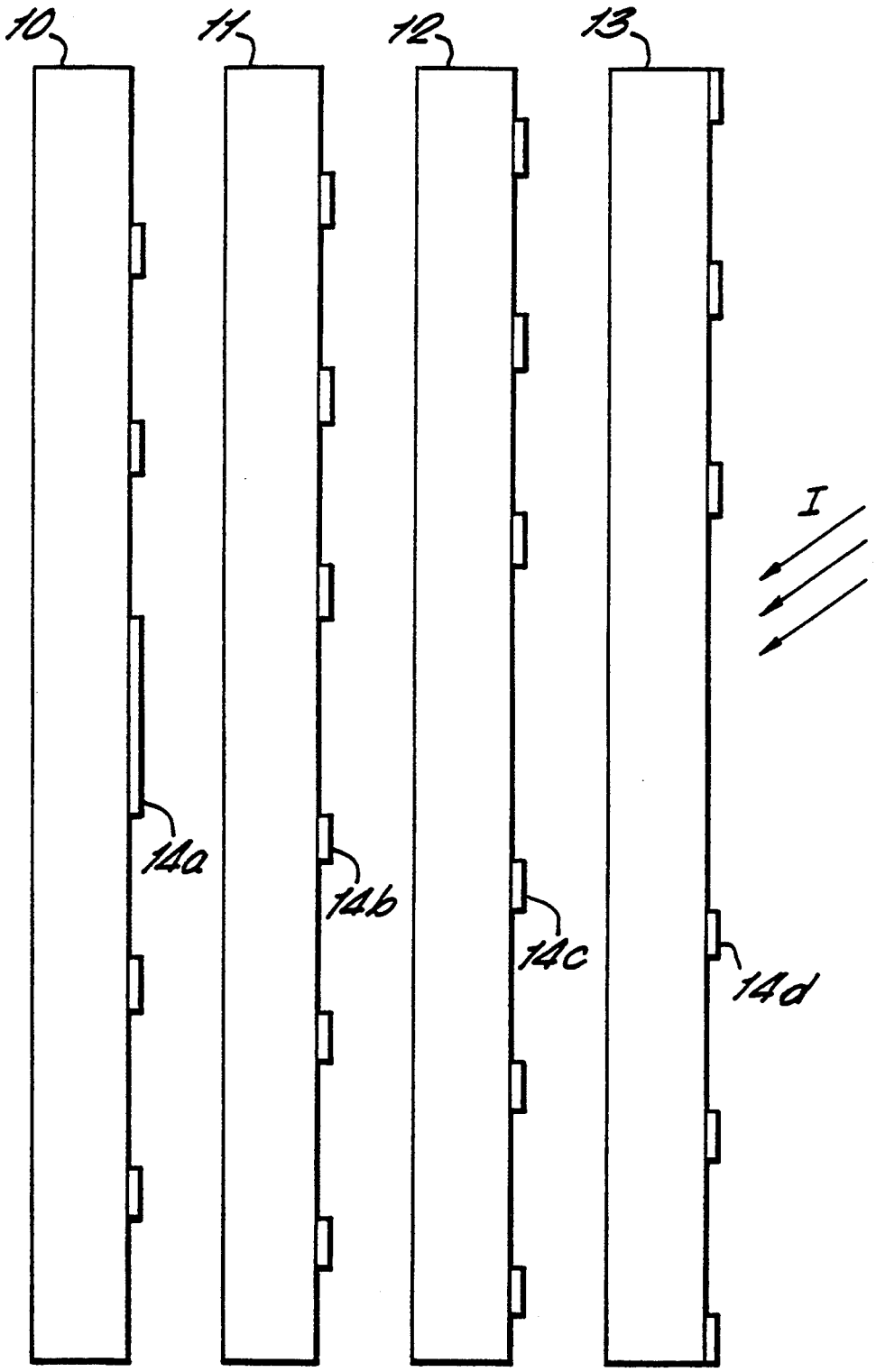
FIG. 2 illustrates a cross-section of a quarter wave zone plate constructed from panels according to one embodiment of the present invention.

Referring now to FIG. 2, this drawing illustrates in cross-section the use of 4 adjacent panels 10, 11, 12 and 13 of electrical thickness λ/8 in a quarter wave zone plate. In this and the rest of the drawings the panels are shown separated for clarity.

On each of the panels 10, 11, 12 and 13 are reflective portions 14*a*, 14*b*, 14*c* and 14*d*. These reflective portions correspond to the zones of a fresnel zone plate and will be in the shape of rings on these panels 10, 11, 12 and 13, except for the central zone of zones 14*a* which will be disc shaped. The reflective portions 14*a*, 14*b*, 14*c* and 14*d* are on a front face facing the incident signal I of each of the panels 10, 11, 12 and 13. The panels 10, 11, 12 and 13 can be made from a plastic material and to simplify the construction of a complete zone plate, the permittivity of the plastic can be chosen such that the electrical thickness of the panels 10, 11, 12 and 13 can be $\lambda/8$ where $\lambda$ is the wavelength of the energy to be focused. Thus the panels can be put in direct contact with each other.

The reflective portions 14*a*, 14*b*, 14*c* and 14*d* can be formed on the panels 10, 11, 12 and 13 by silk screen printing, by using self adhesive metal foil or by metalised foil.

Figure 3:
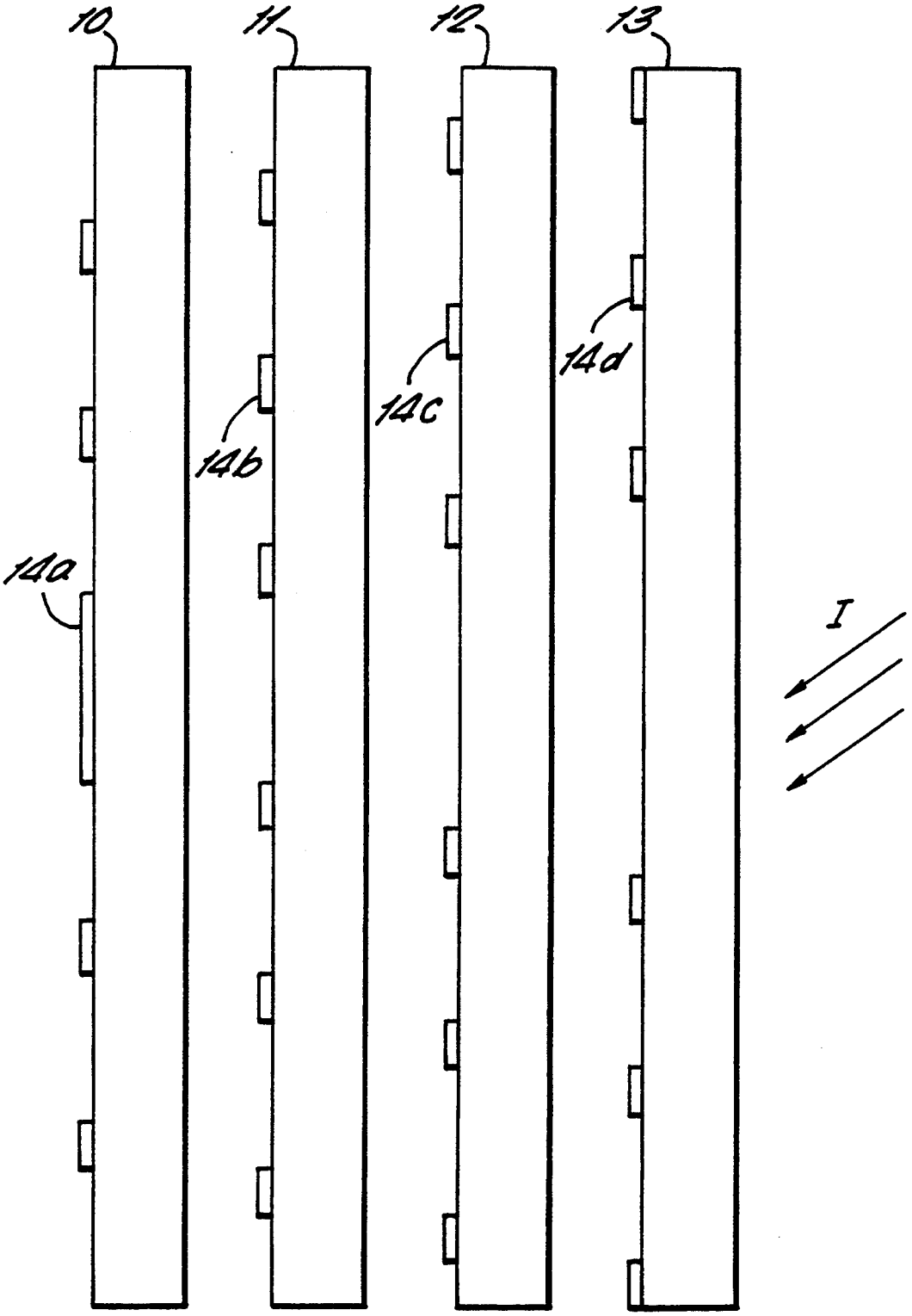
FIG. 3 illustrates a cross-section of a quarter wave zone plate constructed from panels according to another embodiment of the present invention.

FIG. 3 illustrates another embodiment of the present invention wherein the reflective portions 14*a*, 14*b*, 14*c* and 14*d* are on a back face of each of the panels 10, 11, 12 and 13. This arrangement protects the fragile reflective portions 14*d* on panel 13 from accidental damage at the surface of the zone plate.

Figure 4:
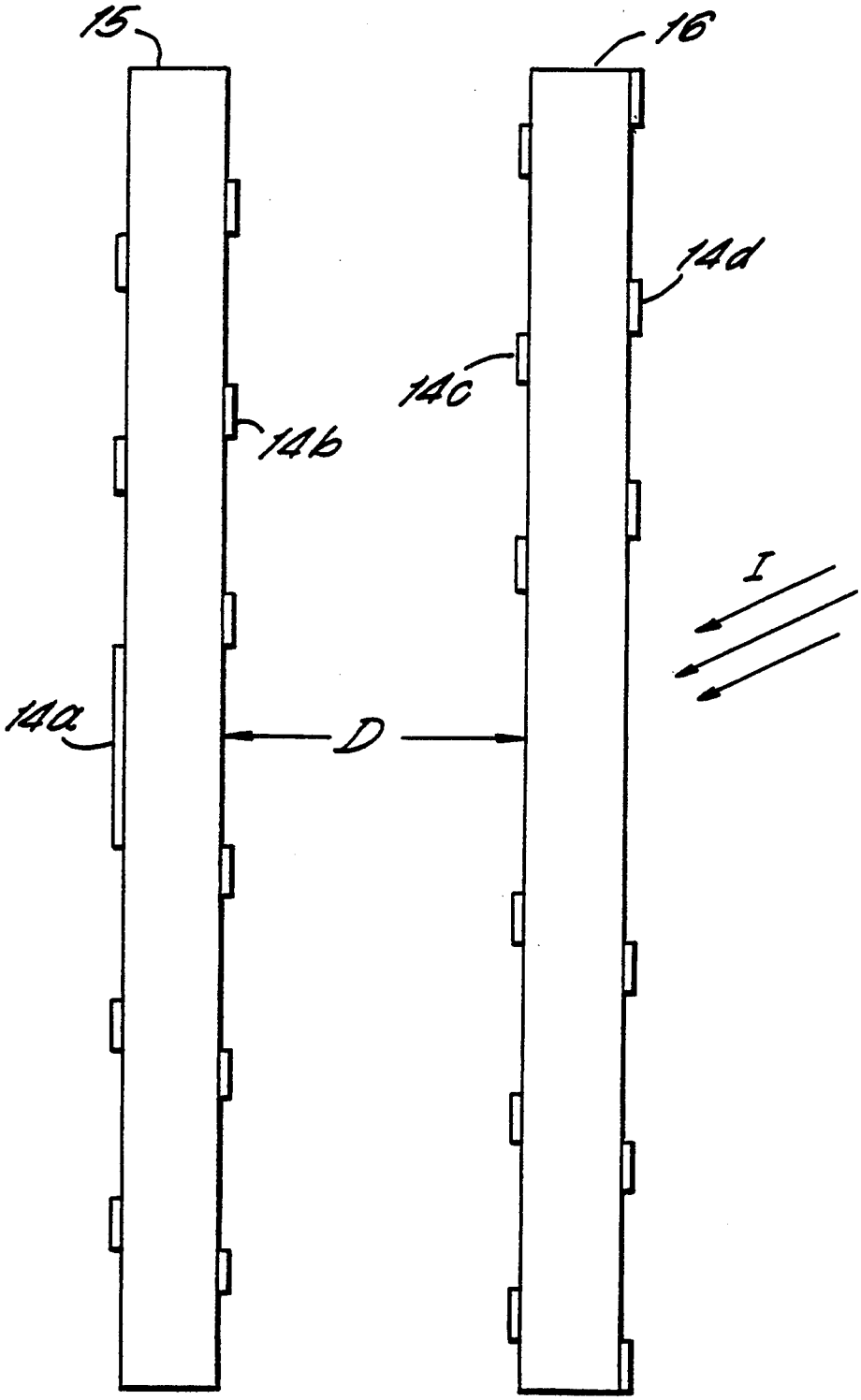
FIG. 4 illustrates a cross-section of a quarter wave zone plate constructed from panels according to a further embodiment of the present invention.

Another arrangement is shown in FIG. 4 wherein only two panels 15 and 16 are used. In this arrangement the reflective portions 14*a*, 14*b*, 14*c* and 14*d* are provided on both front and back faces of the panels 15 and 16. The spacing D between the panels can then be air or a further panel (not shown) having an electrical thickness of $\lambda/8$.

Using this arrangement it is possible to achieve some variation in electrical performance of the zone plate structure.

Figure 5:
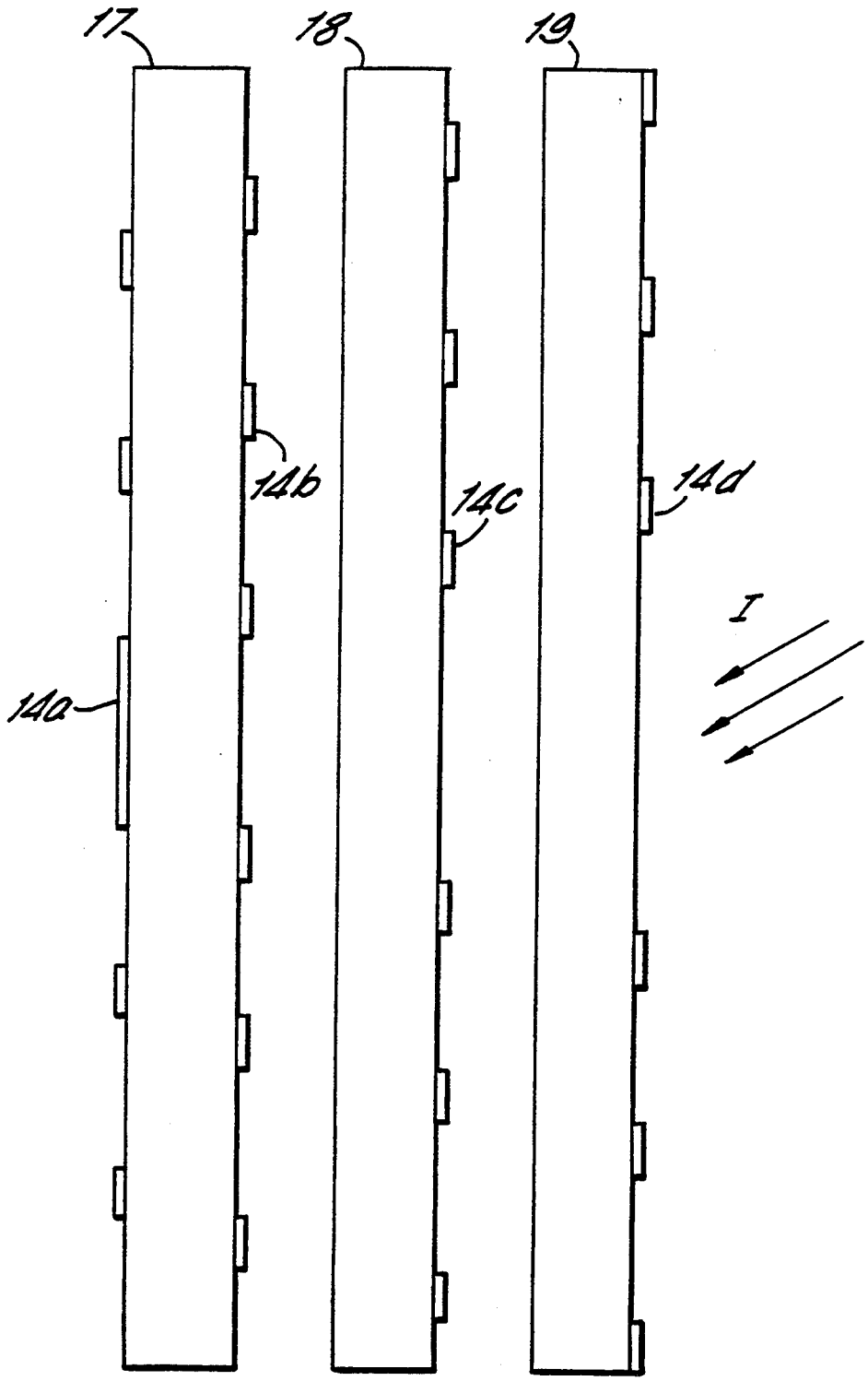
FIG. 5 illustrates a cross-section of a quarter wave zone plate constructed from panels according to a still further embodiment of the present invention.

FIG. 5 illustrates a further example which combines the features of FIGS. 2 and 4. In this example three panels 17, 18 and 19 are provided with panel 17 being provided with reflective portions 14*a* and 14*b* on a front and back face and panels 18 and 19 being provided with reflective portions 14*c* and 14*d* respectively.

Figure 6:
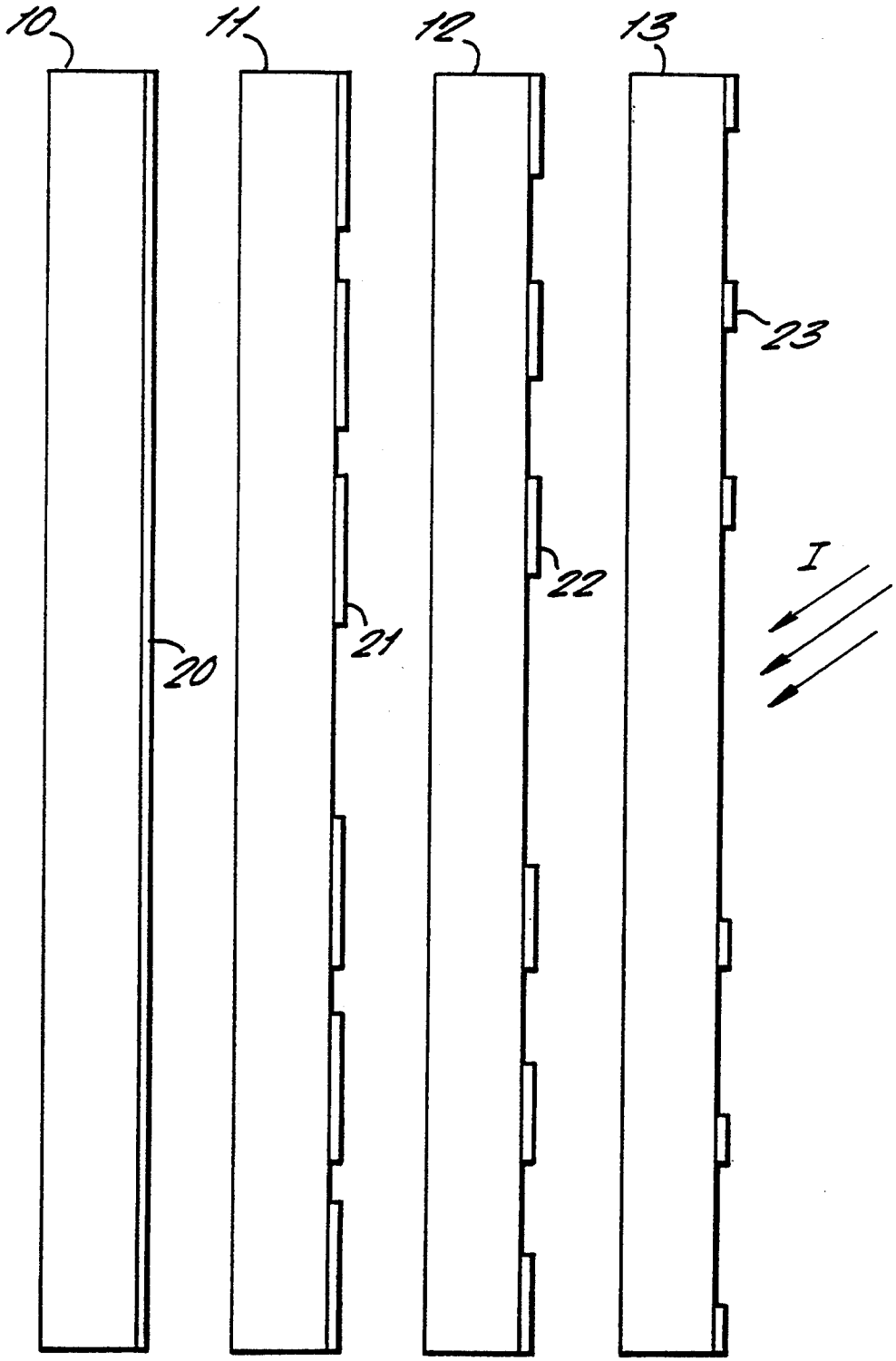
FIG. 6 illustrates a cross-section of a quarter wave zone plate constructed from panels according to another embodiment of the present invention.

In FIG. 6 the reflective portions 20, 21, 22 and 23 are provided on the front faces of the panels 10, 11, 12 and 13 as in FIG. 2. However, the reflective portions 20, 21, 22 and 23 cover all of the face of each respective panel except for areas which are required to be transparent to allow quarter wave phase correction. Thus the rear panel 10 need not have any transparent portions since no signal will reach the areas not contributing to $\lambda/4$ phase correction. This enables easier construction since this panel 20 can be totally reflective.

Figure 7:
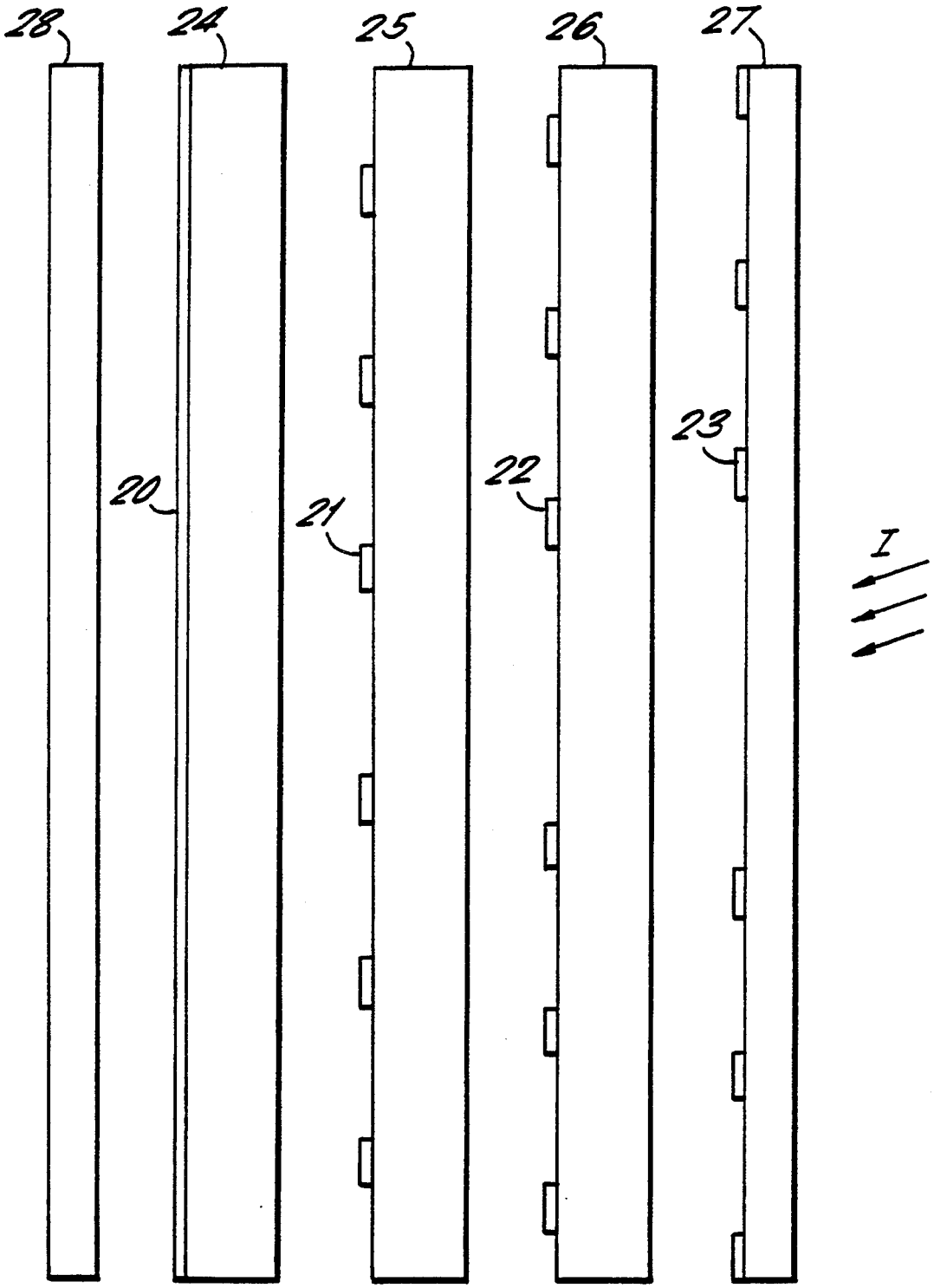
FIG. 7 illustrates a cross section according to a further embodiment of the present invention.

In FIG. 7, a similar zone plate to that shown in FIG. 6 is illustrated, except reversed from the incident radiaton. In this example, three panels 24, 25, 26 are provided to separate the reflective portions 20, 21, 22, 23 by $\lambda/8$. The front panel 27 need not be of any particularly thickness but must provide support as a substrate for the reflective portions 23. This panel 27 also serves the purpose of protecting the reflective portions 23 from damage. The rear panel 28 is provided purely for protection of the rear reflective portion 20.

Figure 8:
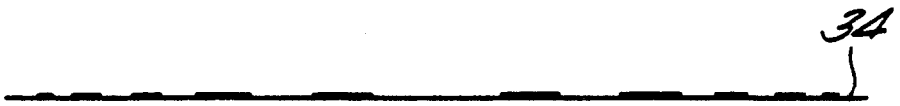
FIG. 8 illustrates a continuous sheet containing all the zones of the zone plate.
Figure 9:
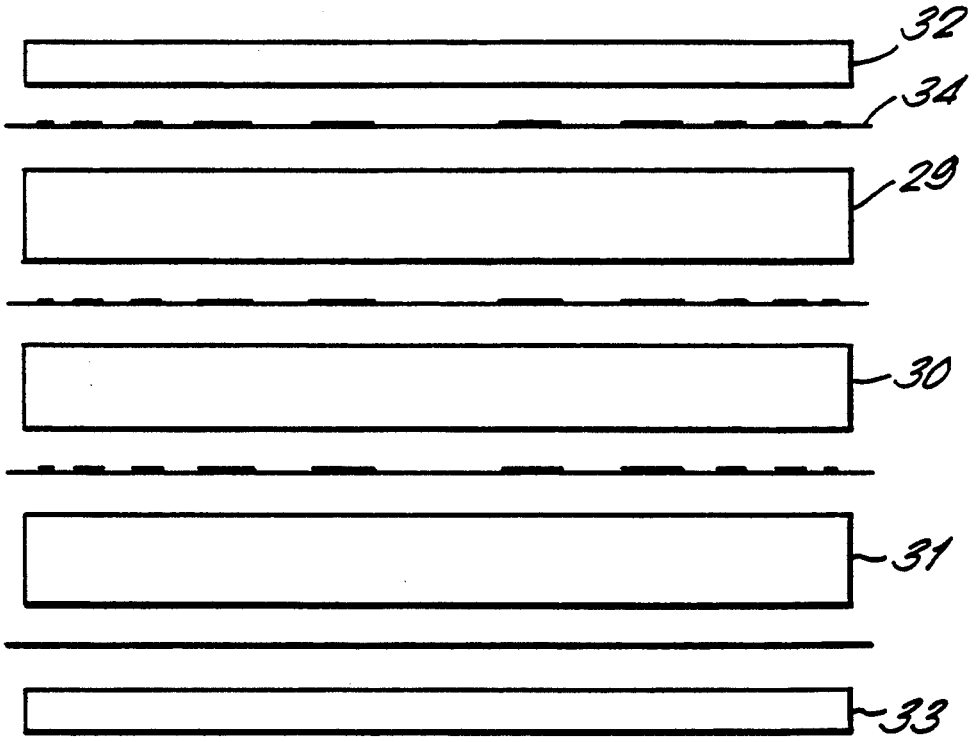
FIG. 9 illustrates the use of sheets separated by panels to form a zone plate according to a further embodiment of the present invention.

In a further embodiment of the present invention, the reflective portions of the zone plate are provided on 4 sheets of plastic film 34, as shown in FIGS. 8 and 9. In this embodiment the sheets are separated by an electrical thickness of $\lambda/8$ using spacer panels 29, 30, 31. Two outer panels 32 and 33 are also provided to protect the sheets. In constructing such a zone plate the sheets 34 are formed by forming the respective zones or reflective portions on the sheet and placing these sheets between panels 29–33 so that they are correctly spaced.

Figure 10:
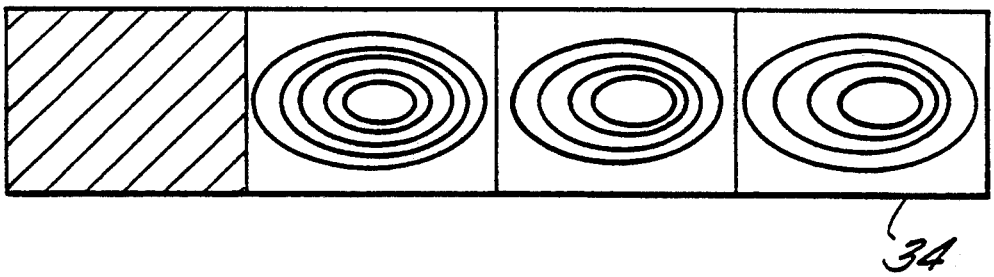
FIG. 10 illustrates the sheets formed from a single sheet of material.
Figure 11:
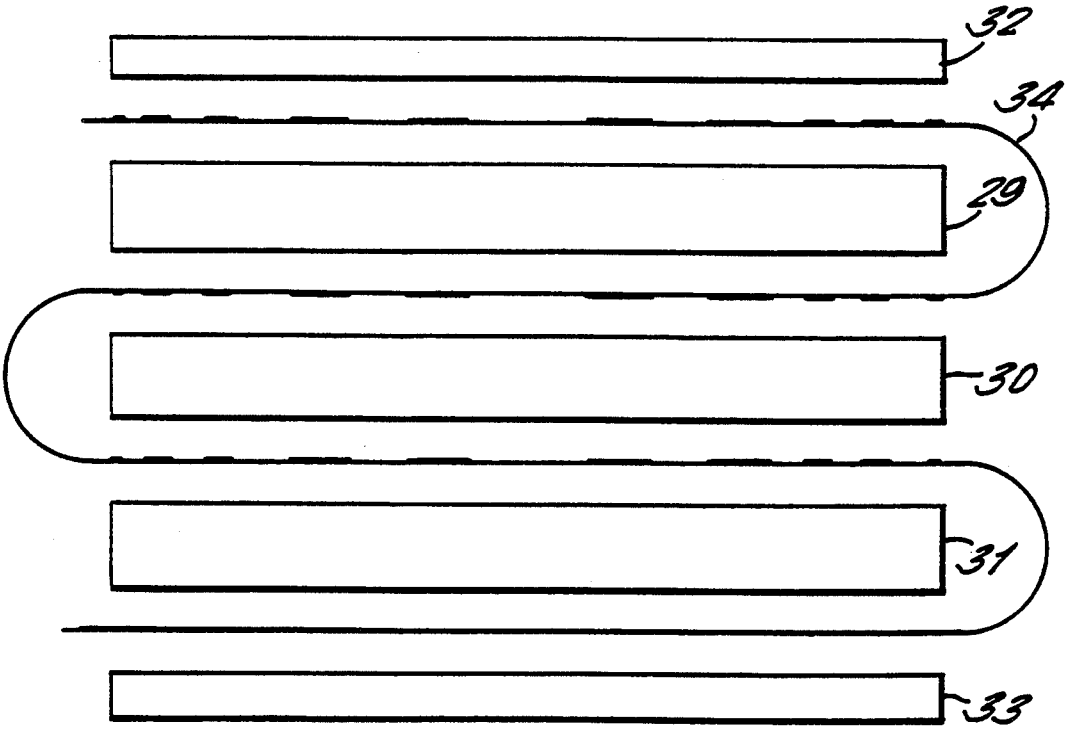
FIG. 11 illustrates a simpler construction of the embodiment of FIG. 9.

FIGS. 10 and 11 illustrate a simplification of the construction of this type. In this example the sheets are formed as one length. The single sheet is then wrapped around alternate panels 29, 30, 31. This simplifies the assembly procedure of this type of zone plate.

In the arrangement illustrated in FIGS. 2 and 3 where the reflective portion corresponding to zones of the zone plate are formed on only one face of the sheets, a simple method of manufacture can be used. This is particularly the case where, as in the arrangements of FIGS. 2 and 3, the total surface area of the reflective portions adds up to the total surface area of the zone plate. In such an arrangement all the reflective portions for the zone plate can be cut out of a single sheet of metalized film. The $m^{th}$ sheet (where m is the sheet number which in these examples is between 1 and 4) has applied to it the $1+(4\ (n+m-2))^{th}$ zone. More generally for cases other than a quarter wave reflection zone plate every $m^{th}$ sheet will have the $1+(P\ (n+m-2))^{th}$ zone applied thereto, where P is the total number of sheets. Thus the present invention is applicable to any reflective zone plate and is not restricted to a quarter wave zone plate.

A method and apparatus for manufacturing reflective zone plates will now be described.

Figure 12:
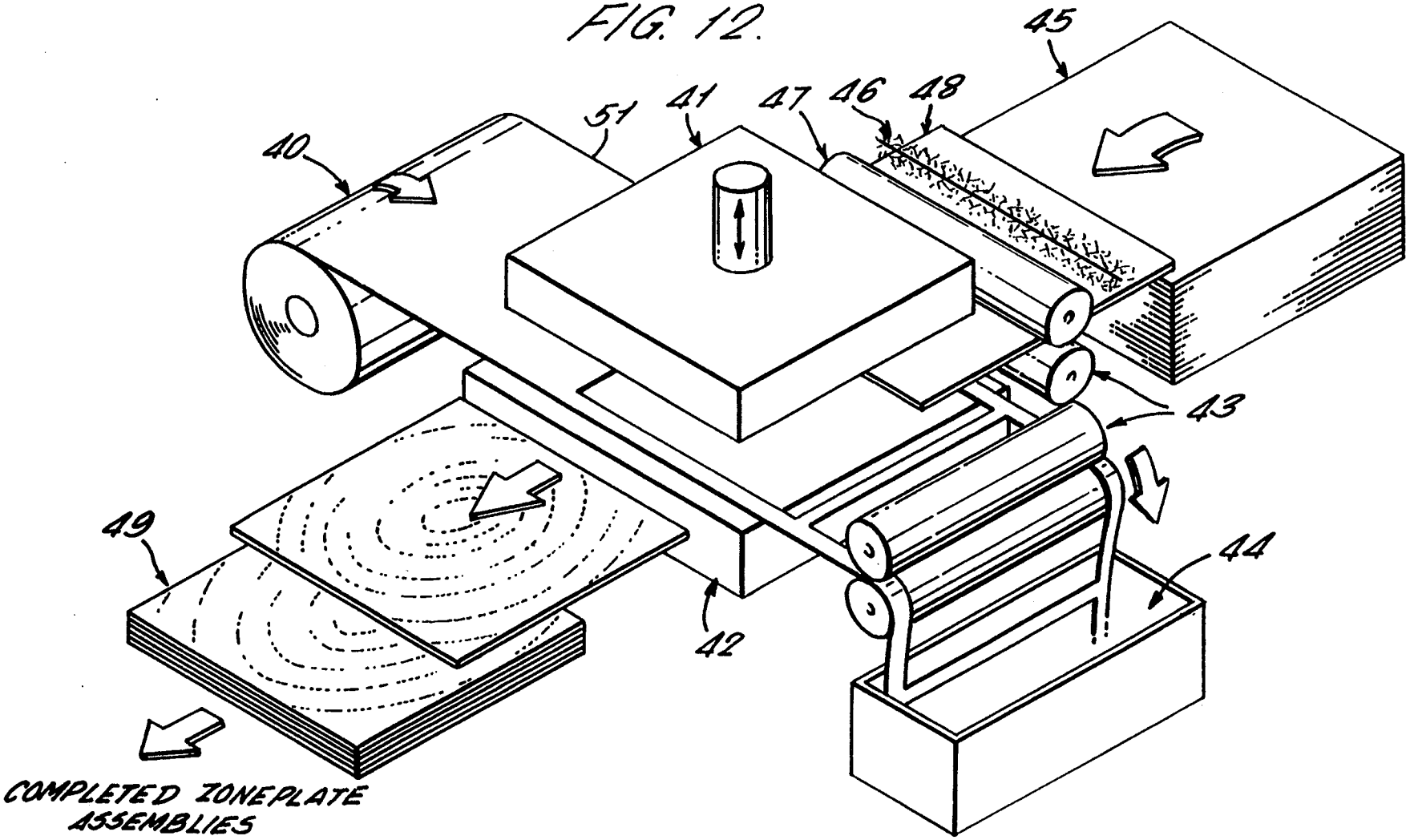
FIG. 12 schematically illustrates apparatus used in the manufacture of the zone plates of the type illustrated in FIGS. 2 and 3.

FIG. 12 illustrates apparatus for the manufacture of a reflection zone plate of the type illustrated in FIGS. 2 and 3. A roll 40 of metalised film is provided to be fad between a kiss-cutting punch and applicator 41 and a press base 42 to nip roller feeds 43. Reflective portions corresponding to zones of a zone plate can then be cut from the metalised film 51 by the action of the kiss-cutting punch and application 41 on the press base 42. Waste metalised film is fed into a waste catchment bin 44, whilst the reflective portions are retained in the applicator 41. A stack 45 of sheets of low loss dielectric material is provided and a single sheet 48 at a time is fed through nip roller feeds 43 to a position between the kiss-cutting punch and applicator 41 and press base 42. During feeding the surface of sheet 48 is subject to anti-static treatment via a tinsel brush 46 and is also coated with a suitable adhesive 47. Once the sheet 48 is in position under the applicator 41 the appropriate ellipses or reflective portions corresponding to zones of a zone plate are deposited and the sheet 48 is then fed out to form a stack 49. Once the correct number of sheets to form a zone plate are stacked light compression is applied to the stack 49 to adhers the sheets 48: the adhesive on the surface not covered by the reflective portions providing the adhesion. Thus a laminate is formed which is ready for fitting into an antenna assembly.

Figure 13A:
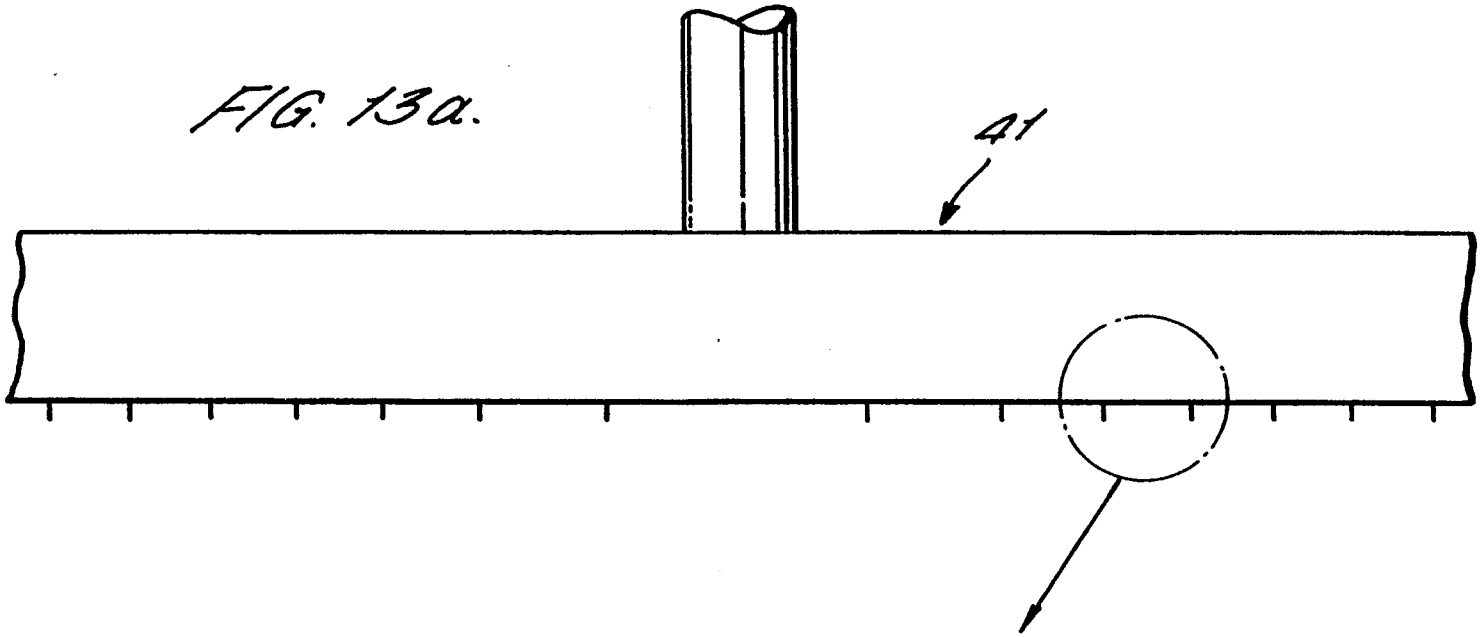
FIGS. 13*a* and 13*b* illustrate a close up of the kiss-cut punch and ellipse applicator.
Figure 13B:
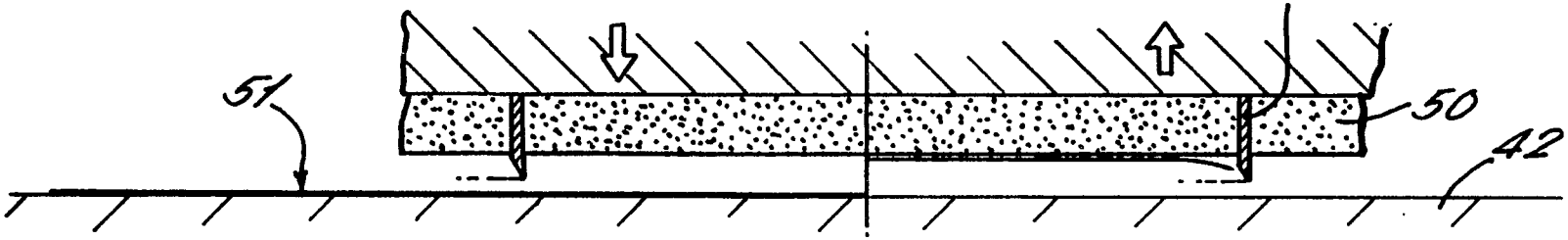

FIGS. 13*a* and 13*b* illustrate the structure of the kiss-cutting punch and applicator 41. Elliptical blades 52 are provided protruding from the underside of the kiss-cutting punch and applicator 41 to co-operate with the press base 42 to cut the metalised film 51 to form the reflective portions. The kiss-cutting punch and applicator 41 is urged towards the press base 42 to cut the metalised film 51. When the cutting action is complete a vacuum is applied through a porous sheet 50 provided on the lower face of the kiss-cutting punch and applicator 41 to hold the reflective portions in place. The kiss-cutting punch and applicator 41 is then raised and a sheet 48 of low loss dielectric material transported to a position beneath it. The kiss-cutting punch and applicator 41 is then lowered to a position very close but not touching and a slight positive pressure is applied through the porous sheet 50 to the appropriate elliptical reflective portions to urge them into position on the face of the sheet 48 of low loss dielectric material, where they will adhere by the action of the adhesive 47 applied during transportation of the sheet 48.

The arrangement thus provides for accurate alignment of the respective zones of the zone plate on the respective sheets since the zones are cut from a single sheet of metalised film and are deposited on the sheets at a single location.

Thus the examples of the invention described hereinabove illustrate the simple construction of a phase correcting zone plate made according to the present invention.

We claim:

1. A reflection zone plate for focusing microwave energy comprises a plurality of reflective portions, each reflective portion corresponding to a zone of said zone plate; said reflective portions being positioned in P parallel planes, so that each said reflective portion reflects energy $\lambda/P$ out of phase with respect to adjacent reflective portions, where $\lambda$ is the wavelength of the energy and P is an integer of 4 or more, such that energy reflected from said reflective portions constructively interferes at a focus of said zone plate; wherein the reflective portions in each said plane are formed on a surface of a planar substrate formed of a material of low dielectric loss.

2. A reflection zone plate as claimed in claim 1 wherein each planar substrate comprises a panel of electrical thickness $\lambda/2P$, there being a plurality of said panels arranged adjacent one another.

3. A reflection zone plate as claimed in claim 2 wherein there are P panels each with said reflective portions mounted on a front face thereof.

4. A reflection zone plate as claimed in claim 2, wherein there are P panels each with said, reflective portions mounted on a back face thereof.

5. A reflection zone plate as claimed in claim 2, wherein said reflective portions are mounted on a front and back face of at least one said panel.

6. A reflection zone plate as claimed in claim 1 wherein each planar substrate comprises a thin sheet separated by panels of low dielectric loss material having an electrical thickness of $\lambda/2P$.

7. A reflection zone plate as claimed in claim 6 wherein each said sheet is joined to form a continuous sheet folded at alternate ends in alternate planes of said sheets.

8. A reflection zone plate as claimed in claim 1 wherein each reflective portion reflects energy $\lambda/4$ out of phase with respect to adjacent reflective portions, and said reflective portions are positioned in 4 parallel planes and separated by an electrical thickness of $\lambda/8$.

9. A reflection zone plate as claimed in claim 1 wherein said planes substrates are constructed from a plastics material.

10. A reflection zone plate as claimed in claim 1 comprising means to apply said reflective portions corresponding to zones of said zone plate to the surface of a plurality P of planar substrates of low dielectric loss material; and means to stack said planar substrates to form said reflection zone plate.

11. Apparatus as claimed in claim 10, wherein said means to apply reflective portions comprises cutting and applicating means for cutting said reflective portions from a metalized film and applying said reflective portions to a surface of said planar substrates; said reflective portions being applied to said planar substrates such that the $m^{th}$ substrate has applied to a surface thereof the $1+(P(n+m-2))$th zone of said reflective zone plate, where n is the zone number and m is the substrate number.

12. Apparatus as claimed in claim 11 further including means to apply adhesive to a surface of said planar substrates of low dielectric loss material before application of said reflective portions to said surface.

13. Apparatus as claimed in claim 11, wherein said metalised film is supplied to said cutting and applicating means from a roll.

14. A method of manufacture of a reflection zone plate comprising the steps of providing a plurality P of at least four planar substrates formed of a material of low dielectric loss, applying reflective portions corresponding to zones of said zone plate to the surfaces of the plurality P of said planar substrates, and stacking said plurality of planar substrates of low dielectric loss material in parallel planes to form said reflection zone plate.

15. A method as claimed in claim 14, wherein said step of application reflective portions comprises cutting said reflective portions from a sheet of metalized film and applying said reflective portions to a surface of said planar substrates; said reflective portions being applied to said planar substrates such that the $m^{th}$ sheet has applied to it the $1+(P(n+m-2))$th zones of said reflective zone plate, where n is the zone number and m is the substrate number.

16. A method as claimed in claim 15, wherein all the reflective portions corresponding to zones of said zone plate are cut from a single piece of said metalized film simultaneously, and the respective reflective portions and are applied to the sequentially fed planar substrates of low dielectric loss material.

17. A method as claimed in claim 15 further including the step of applying adhesive to said surface of said planar substrates prior to the application of said reflective portions.

18. A method as claimed in claim 17, wherein light compresson is applied to the stack of said sheets to laminate said sheets.

* * * * *

UNITED STATES PATENT AND TRADEMARK OFFICE

CERTIFICATE OF CORRECTION

PATENT NO. : 5,389,944

DATED : February 14, 1995

INVENTOR(S) : Gary Collinge and Thomas M.B. Wright

It is certified that error appears in the above-indentified patent and that said Letters Patent is hereby corrected as shown below:

Column 6, line 2, delete "planes" and insert --planar--.

Signed and Sealed this

Twenty-third Day of May, 1995

*Attest:*

Bruce Lehman

BRUCE LEHMAN

*Attesting Officer*

*Commissioner of Patents and Trademarks*